US005579708A

United States Patent [19]

Kambara et al.

[11] Patent Number: 5,579,708

[45] Date of Patent: Dec. 3, 1996

[54] CLOTH FEEDING IN A MASK SEWING DEVICE

[75] Inventors: Tetsuo Kambara; Hiroshi Kojima, both of Utsunomiya, Japan

[73] Assignee: The Singer Company N.V., Curaco, Netherlands Antilles

[21] Appl. No.: 283,930

[22] Filed: Aug. 1, 1994

[30] Foreign Application Priority Data

Sep. 10, 1993 [JP] Japan ..... 5-248486

[51] Int. Cl.[6] ..... D05B 25/00; D05B 27/10

[52] U.S. Cl. ..... 112/155; 112/304; 112/317; 112/320

[58] Field of Search ..... 112/235, 318, 112/322, 360, 10, 304, 307, 317, 259, 155, 320

[56] References Cited

U.S. PATENT DOCUMENTS

| | | | |
|---|---|---|---|
| 2,241,230 | 5/1941 | Wilmoth | 112/304 |
| 3,224,394 | 12/1965 | Dobner et al. | 112/10 |
| 4,272,980 | 6/1981 | Ochi et al. | 112/304 X |
| 4,607,582 | 8/1986 | Blocklehurst | 112/318 X |
| 5,038,692 | 8/1991 | Bisson | 112/317 X |
| 5,133,273 | 7/1992 | Brocklehurst | 112/10 X |
| 5,410,975 | 5/1995 | Dudek et al. | 112/304 X |
| 5,458,074 | 10/1995 | Kojima et al. | 112/304 X |

*Primary Examiner*—Ismael Izaguirre
*Attorney, Agent, or Firm*—McCormick, Paulding & Huber

[57] ABSTRACT

A mask sewing device comprises a pair of sewing machines which are fixed to a working table, being arranged left and right thereon in such a way as to face each other, and are operated in synchronism with each other, a pair of belts provided apart from each other on the working table by a given interval, each belt extending between the mask cloth feeding side and mask cloth sending-out side of the working table and a feeding unit for driving the belts in the normal and reverse directions, wherein the sewing machines can concurrently sew the folded end portions of the mask cloth at both sides thereof respectively, the mask cloth being inserted into the interval from the feeding side. Since the mask cloth is sewn by a pair of sewing machines while belts are driven normally and reversely by a feeding unit to feed the folded mask cloth forward and backward on the working table, it is possible to efficiently sew a mask of high quality in which stitch lines on both sides thereof are uniform and symmetrical to each other without veteran skill. As a result, it is possible to make practiceable the sewing processes in a sewing factory.

2 Claims, 6 Drawing Sheets

CLOTH FEEDING IN A MASK SEWING DEVICE

BACKGROUND OF THE INVENTION

1. Field of the Invention

The present invention relates to a mask sewing device for sewing a folded gauze mask concurrently at the both end portions thereof.

2. Prior Art

A conventional mask cloth A of gauze as illustrated in FIG. 8 is made by forming stitch lines FT on a folded gauze-mask cloth by a sewing machine at the positions apart from the end portions thereof by a given distance AL respectively. Back tack stitches BT are formed at the starting and ending portions of each of the stitch lines FT in order to prevent the same from coming loose.

As described above, conventional mask sewing device respectively sews the folded mask cloth at each end portion thereof using a usual sewing machine. As a result, veteran skill is required for efficiently sewing a mask of high quality in which stitch lines are formed uniformly and symmetrically to each other on both sides thereof, causing a bottleneck in making such a sewing process practiceable in sewing factories.

SUMMARY OF THE INVENTION

The present invention has been made in view of such a technical problem of the prior art. A mask sewing device according to the invention is characterized in comprising a pair of sewing machines 1 and 1 which are fixed to a working table 2 being arranged left and right thereon in such a way as to face each other and are operated in synchronism with each other, a pair of belts 14 provided apart from each other on the working table 2 by a given interval, each belt 14 extending between the mask cloth A feeding side X and mask cloth A sending-out side Y of the working table 2 and a feeding unit 7 for driving the belts 14 in the normal and reverse directions, wherein the sewing machines 1 and 1 can concurrently sew the folded end portions A1 and A2 of the mask cloth A at both sides thereof respectively, the mask cloth A being inserted into the interval S from the feeding side X.

A mask sewing device according to the invention is further characterized in that the feeding unit 7 set forth above comprises a pair of supporting members *6a* and *6b* which face each other on the working table 2 with a given interval S therebetween, at least three rotating shafts 12, two of which extend between the lower portions of the supporting members *6a* and *6b*, a driving shaft 9, pulleys 10 a pair of which are fixed to each of the rotating shafts 12 and driving shaft 9 and a rotation drive source wherein the two belts 14 are wound around the pulleys 10 set forth above.

A mask sewing device according to the invention is still further characterized in that each belt 14 positioned adjacent to each seam line in the folded end portions A1 and A2 at the outer edge portion thereof is normally and reversely driven and is equipped with a presser foot 24 which adjustably contacts the upper surface thereof so as to clamp the mask cloth A between each belt 14 pressed down by the presser foot 24 and a mask cloth carrier plate 5 which is provided on the working table 2 for carrying the mask cloth A thereon.

According to one embodiment of the invention, at first, the belts 14 alone are driven and the sewing machines 1 and 1 are not in operation. When an operator inserts the mask cloth A into the interval S between the belts 14 and working table 2 from the feeding side X thereof, the mask cloth A is fed toward the sending-out side Y thereof by the belts 14. Meanwhile, a pair of sewing machines 1 and 1 perform sewing while the feeding unit 7 drives the belts 14 normally or reversely to form back tack stitches at the front and rear end portions of the mask cloth A and stitch lines which stitch the folded end portions A1 and A2 together on the mask cloth A to complete sewing a mask. After completion of sewing, the mask can be taken out by driving the belts 14.

In a preferred embodiment of the invention, the belts 14 wound around the pulleys 10 a pair of which are respectively fixed to each of the rotating shafts 12 and the driving shaft 9 are driven to rotate normally and reversely as the rotation drive source 11 rotates the driving shaft 9 in the normal and reverse directions respectively. As a result, each belt 14 moves almost horizontally between the pulleys 10 of the two rotating shafts 12 that are provided in the lower portions of the supporting members *6a* and *6b* to smoothly feed the mask cloth A between the belts 14 and working table 2.

According to a second preferred embodiment the invention, since each of the folded end portions A1 and A2 of the mask cloth A on the mask cloth carrier plate 5 provided on the working table 2 is clamped between each belt 14 and the mask cloth carrier plate 5 and moreover each belt 14 is positioned adjacent to each stitch line on each of the folded end portions A1 and A2 at the outer edge portion thereof, back tack stitches formed at the front and rear end portions of the mask cloth A and each stitch line which stitches each of the folded end portions A1 and A2 together are formed well at each of the folded end portions A1 and A2.

PREFERRED EMBODIMENT OF THE INVENTION

An embodiment of the present invention will be described hereinafter with reference to drawings.

FIG. 1 to 18 show the embodiment. In FIG. 2, denoted at 1 and 1 are sewing machines mounted on a working table 2, the sewing machines 1 and 1 being arranged left and right thereon apart from each other by a given interval and facing each other. The sewing machines 1 and 1 are driven in synchronism with each other by a driving motor, not shown, provided under the working table 2 by way of timing belts 3. It is possible to sew the both side portions of the mask cloth A concurrently by the pair of sewing machines 1 and 1.

Figure 8:
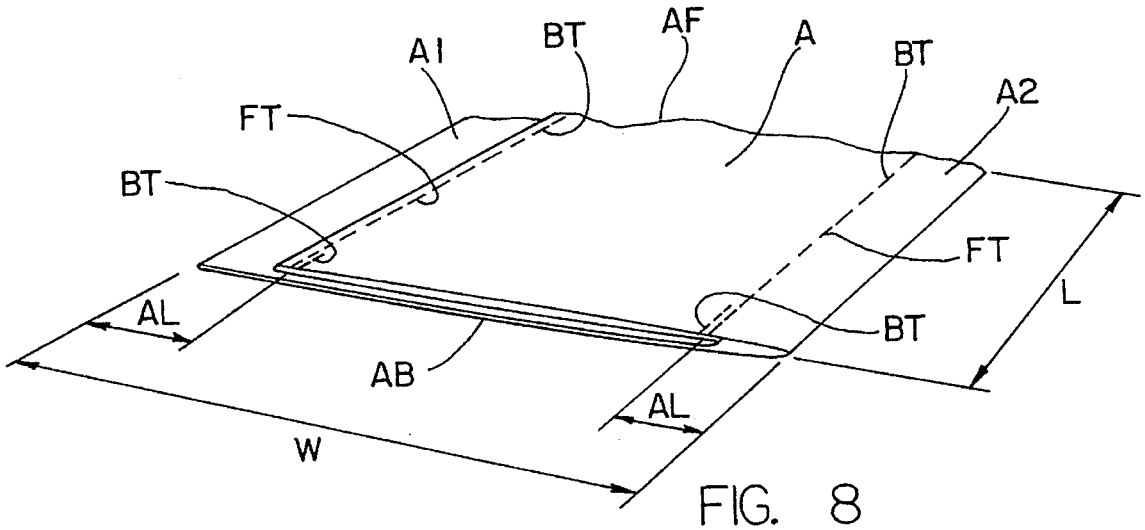
FIG. 8 is a perspective view showing a mask cloth in FIG. 1.

The mask cloth A is made of gauze and has a rectangular shape having a width W and a length L with folded end portions A1 and A2 formed at both end portions thereof in the direction of the width W as illustrated in FIG. 8. Such a mask cloth A is subjected to sewing in each of the folded end portions A1 and A2 thereof at the positions apart from the end portions by a given distance AL to form stitch lines FT which stitch the folded end portions A1 and A2 together and back tack stitches BT adjacent to the front end portion AF and rear end portion AB of the stitch lines FT at the start and end of sewing to prevent the stitch lines FT from coming loose.

Denoted at 4 are guide members which are provided on the central portion of the working table 2 apart from each other by the width W of the mask cloth A in such a way as to face each other. The guide members 4 and the mask cloth carrier plate 5 fixed to the central portion of the working table 2 define a path for feeding therethrough the mask cloth A to be sewn. Needle holes for passing the needles N of the sewing machines 1 and 1 respectively therethrough are formed in the mask cloth carrier plate 5.

Denoted at **6*a* and 6*b* are arched supporting members, which stand astride the sewing machines 1 and 1 respectively. The supporting members 6*a* and 6*b* are properly connected to each other by connecting members 6*c* to form the frame 6 of the feeding unit 7. A driving shaft 9, three rotating shafts 12 and a supporting shaft 15 are supported between the supporting members 6*a* and 6*b* as illustrated in detail in FIG. 5**.

Figure 3:
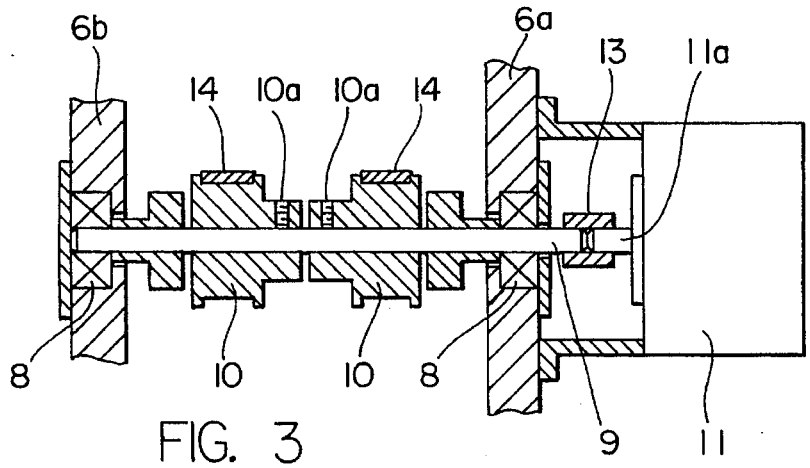
FIG. 3 is a cross-sectional view showing the mounting state of a driving shaft in FIG. 1.

The driving shaft 9 disposed above the rear portion of the working table 2 is rotatably supported by the supporting members **6*a* and 6*b* by way of bearings 8 respectively as illustrated in FIG. 3, and the rotating shaft 11*a* of a pulse motor 11 serving as a rotation drive source mounted on the side surface of a supporting member 6*a* is connected to the driving shaft 9 by way of a reduction gear, not shown, and a coupling 13. A pair of toothed pulleys 10 are fixed to the driving shaft 9 by set screws 10*a*** in bilateral symmetry.

Figure 4:
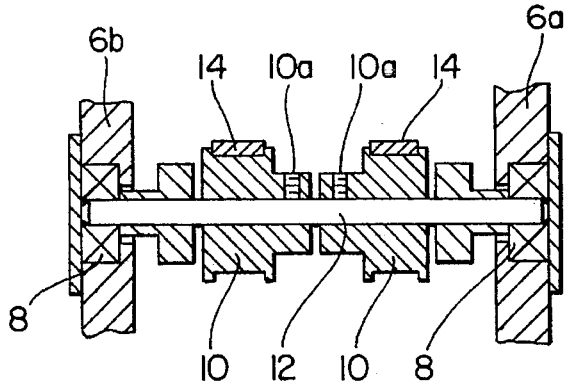
FIG. 4 is a cross-sectional view showing the mounting state of a rotating shaft in FIG. 1.

The rotating shafts 12 and the driving shaft 9 arranged at the vertexes of a substantial rectangle are rotatably supported by each of the supporting members **6*a* and 6*b* by way of the bearings 8 and a pair of pulleys 10 are fixed to each of the rotating shafts 12 by the set screws 10*a* as illustrated in FIG. 4. Two rotating shafts 12, one extending between the front lower portions of the supporting members 6*a* and 6*b* and the other extending between the rear lower portions thereof, are arranged on a horizontal plane. Since the toothed endless belts 14 are wound around the pairs of the pulleys 10, the belts 14 are turned normally and reversely by driving the pulse motor 11 in the normal and reverse directions respectively. The supporting shaft 15 is supported between the driving shaft 9 and a rotating shaft 12 adjacent thereto by the supporting members 6*a* and 6*b* in such a way as to be adjustable in mounting position thereon and rotatably supports a single tension pulley 16. It is possible to apply a proper tension to the pair of belts 14 which are in contact with the single tension pulley 16 by adjusting the mounting position of the supporting shaft 15. The frame 6, driving shaft 9, rotating shafts 12, pulleys 10, pulse motor 11, etc. constitute the feeding unit 7 which drives the belts 14** in the normal and reverse directions.

Figure 5:
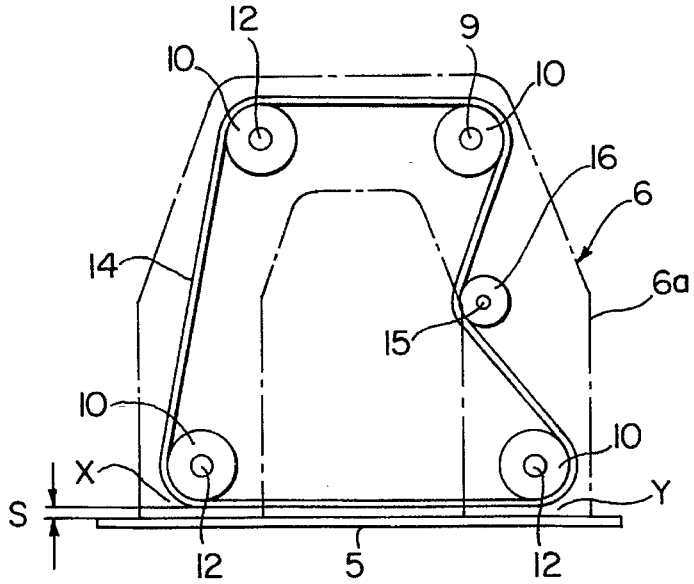
FIG. 5 is a side view showing the wound state of an endless belt in FIG. 1.

The pair of belts 14 which are disposed in parallel to each other and to which tension is applied by the single tension pulley 16, each belt 14 being wound around each set of the pulleys 10, are in a substantially horizontal plane apart from the upper surface of the mask cloth carrier plate 5 by the interval S at the portions thereof between the pulleys 10 around two rotating shafts 12 disposed at the front and rear lower end portions of the supporting members **6*a* and 6*b* as illustrated in FIG. 5. The rear sides of the horizontal portions of the belts 14** form the feeding side X and the front sides thereof form the sending-out side Y.

Figure 7:
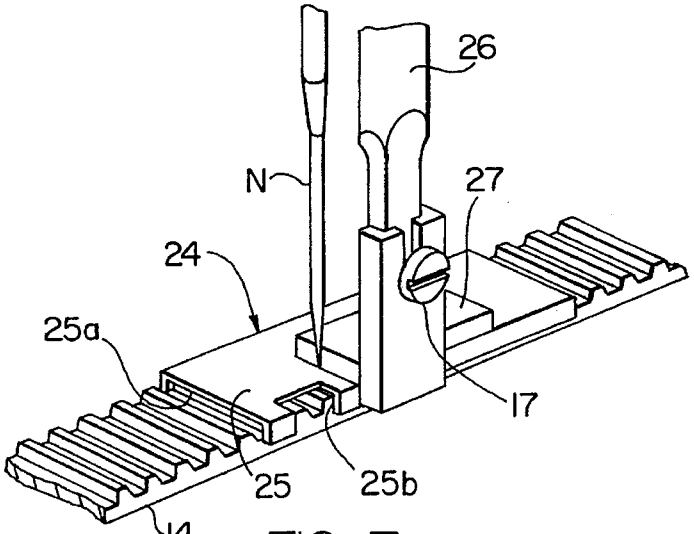
FIG. 7 is a perspective view showing the mounting state of presser feet in FIG. 1.
Figure 6:
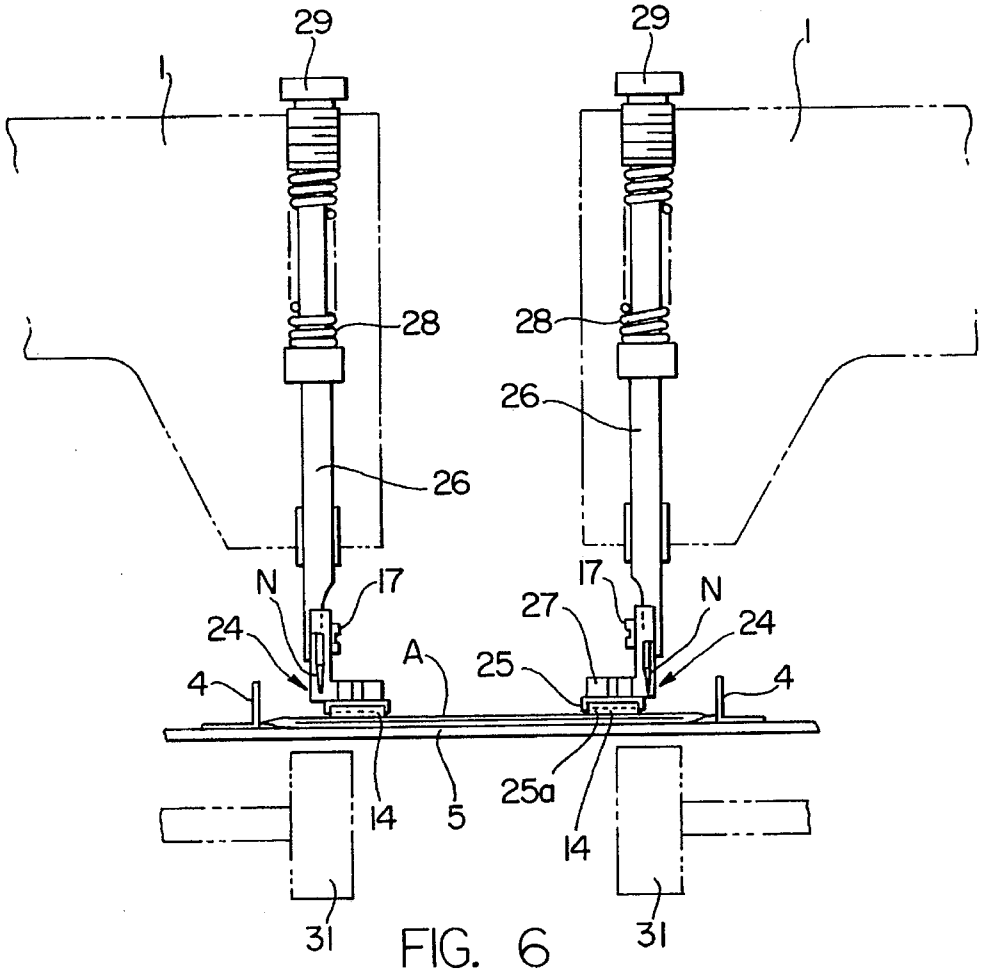
FIG. 6 is a front view showing an important part of the sewing machine in FIG. 1.

On the other hand, each of the sewing machines 1 and 1 is equipped with a well-known presser bar 126 for a sewing machine, and an adjustable presser foot 24 is attached to the lower end portion of each presser bar 26 as illustrated in detail in FIGS. 6 and 7. The presser foot 24 is composed of an upper member 27 and a lower member 25 which are fixed to each other, and the lower end portion of the presser bar 26 is engaged into a recessed portion of the upper member 27 and is fixed thereto by a set-screw 17 in such a way as to be vertically adjustable. The lower member 25 has an inverted. U-shape in cross section to form a belt channel **25*a* therein, through which the belt 14 can slidably pass, and has a partially notched opening portion 25*b* on the side thereof so that the outer edge of the belt 14 which moves while pressing down the mask cloth A may be disposed adjacent to the sewing needle N. In FIG. 6, denoted at 31** are hooks.

Such presser feet 24 press down the belts 14 which are in contact with the mask cloth A by a given pressure, thereby properly clamping the mask cloth A passing thereunder guided by a pair of guide members 4 between the mask cloth carrier plate 5 and belts 14, the mask cloth A being inserted from the feeding side X and sent out from the sending-out side Y. That is, each presser bar 26 is adjustable in the downward pressure of the presser foot 24 thereof by turning each thumb screw 29 screwed into each of the sewing machines 1 and 1 normally or reversely to adjust the resilience of each spring 28 thereby to elastically clamp the mask cloth A between the belts 14 received in the lower members 25 of the presser feet 24 and the mask cloth carrier plate 5 for smoothly feeding the mask cloth A by driving the endless belts 14 as illustrated in FIG. 6.

Figure 1:
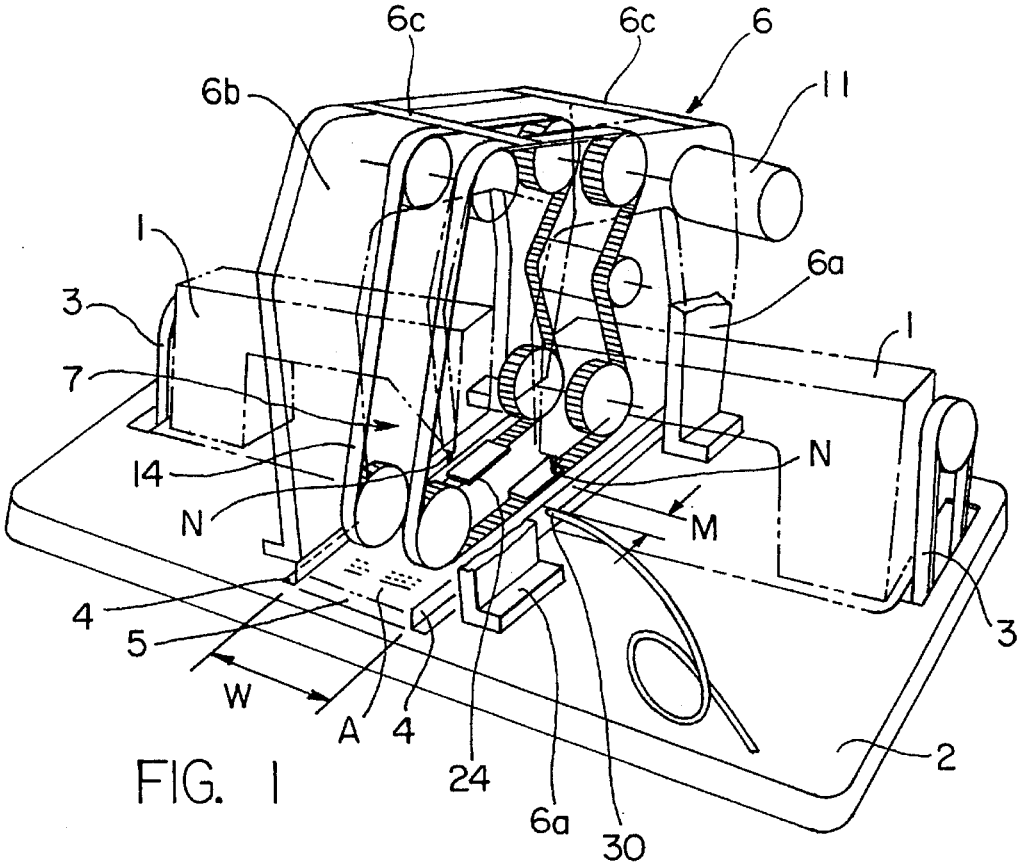
FIG. 1 is a perspective view showing a mask sewing device according to an embodiment of the present invention.
Figure 2:
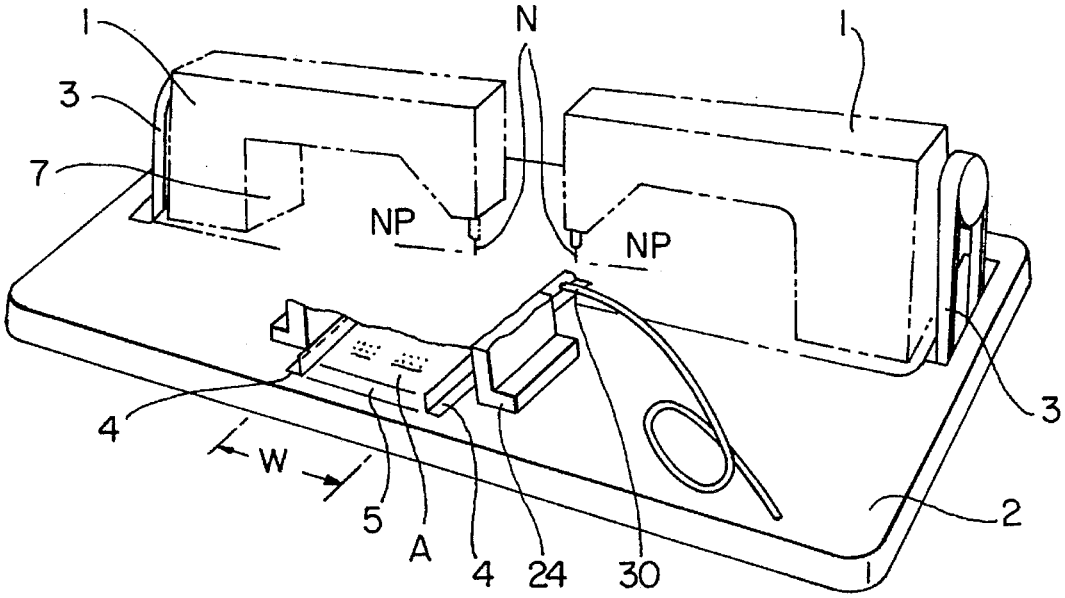
FIG. 2 is a perspective view showing the arrangement of sewing machines in FIG. 1.

In FIGS. 1 and 2, denoted at 30 is a sensor, which is provided at a position on the feeding side X (front side) of the mask cloth A relative to the needle position NP which is a line segment connecting the sewing needles N, the position being apart from the needle position NP by a given distance M, for detecting the front end portion AF and rear end portion AB of the mask cloth A to produce a detection signal.

The sensor 30 can be, for example, a photosensor composed of a light emitting element and a light receiving element. The pulse motor 11 and sewing machines 1 and 1 are controlled in operation based on the detection signal produced by the sensor 30.

Figure 16:
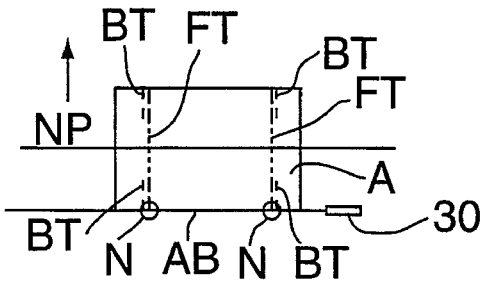
FIG. 16 is a view for explaining the operation of the mask sewing device in FIG. 1.
Figure 17:
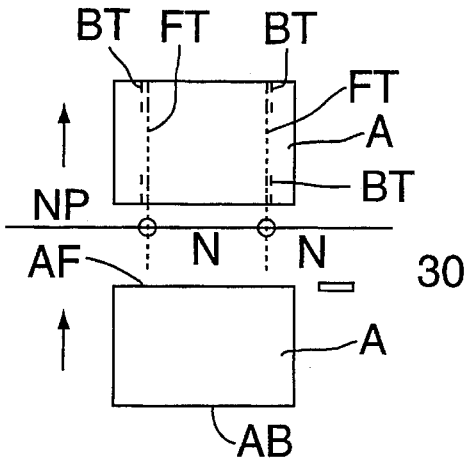
FIG. 17 is a view for explaining the operation of the mask sewing device in FIG. 1.
Figure 18:
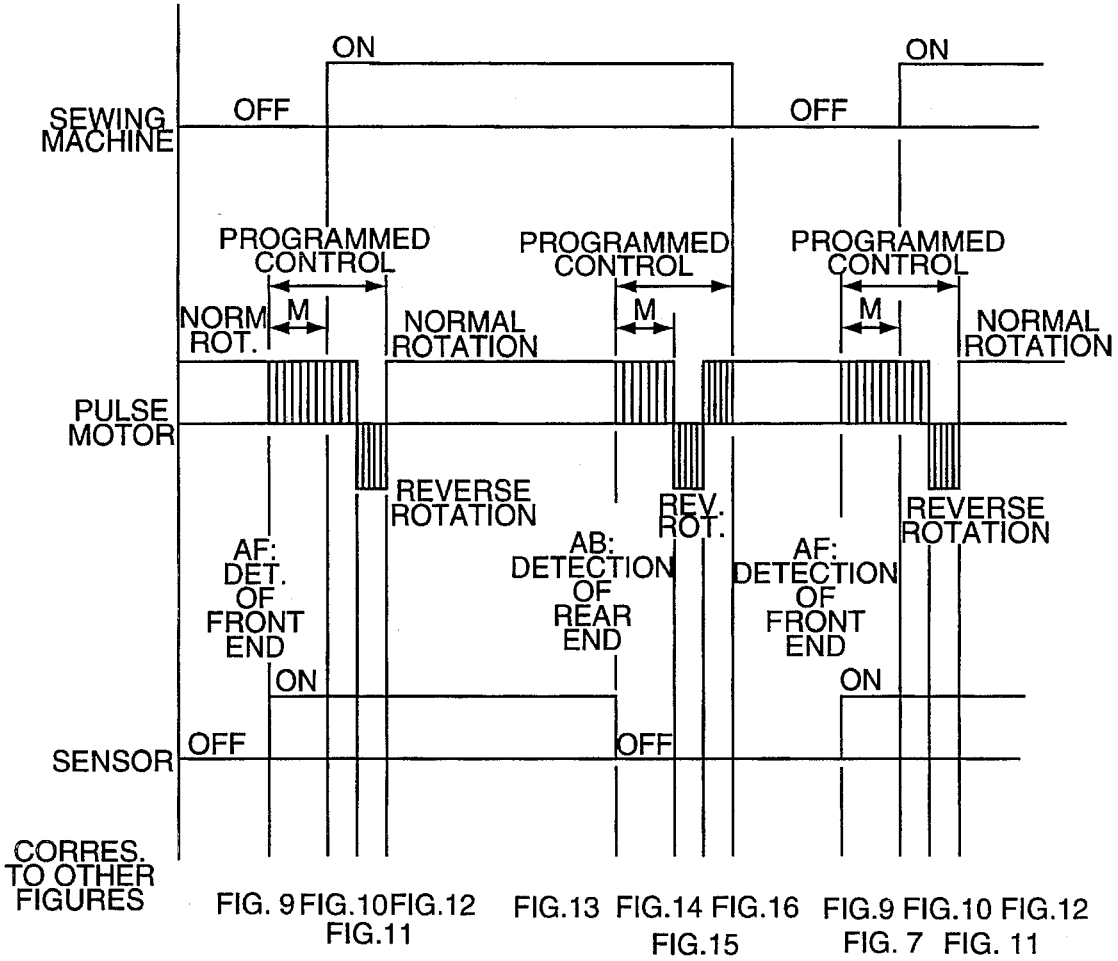
FIG. 18 is a timing chart of operation of components in FIG. 1.

The operation of the above embodiment will be described hereinafter with reference to FIGS. 9 to 17 and a timing chart in FIG. 18. In FIGS. 9 to 17, arrows indicate the feeding direction of the mask cloth A.

Figure 9:
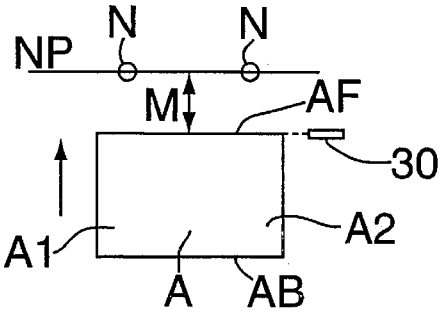
FIG. 9 is a view for explaining the operation of the mask sewing device in FIG. 1.

At first, the endless belts 14 alone are driven by the pulse motor 11 rotating normally while the sewing machines 1 and 1 (sewing machine motor) are not in motion. When the mask cloth A is inserted between the endless belts 14 and the mask cloth carrier plate 5 from the feeding side X by an operator, the mask cloth A is fed over the mask cloth carrier plate 5 by the endless belts 14 toward the sending-out side Y being guided by the guide members 4 at the both ends thereof in the direction of width W. When the front end portion AF of the mask cloth A is detected by the sensor 30 provided on the front side of the needle position NP and a detection signal (ON) is produced as illustrated in FIG. 9, a control device starts programmed control based on the detection signal (ON) to continue the normal rotation of the pulse motor 11 for feeding the mask cloth A by the given distance M until the front end portion AF of the mask cloth A reaches the needle position NP.

Figure 10:
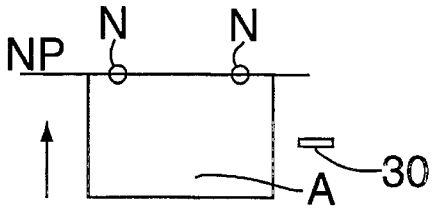
FIG. 10 is a view for explaining the operation of the mask sewing device in FIG. 1
Figure 11:
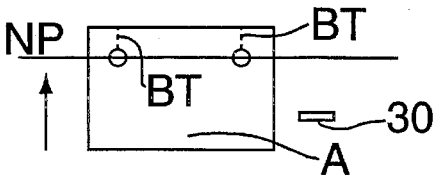
FIG. 11 is a view for explaining the operation of the mask sewing device in FIG. 1
Figure 12:
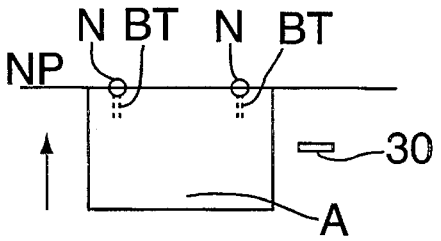
FIG. 12 is a view for explaining the operation of the mask sewing device in FIG. 1

When the mask cloth A is fed by the given distance M set forth above as illustrated in FIG. 10, the sewing machines 1 and 1 are turned on to start sewing based on the programmed control of the control device. As a result, back tack stitches BT are formed in forward sewing by a predetermined number of stitches as illustrated in FIG. 11. When forming the back tack stitches BT in forward sewing by a predetermined number of stitches is completed, the pulse motor 11 is driven reversely to form the back tack stitches BT by backward sewing and the front end portion AF of the mask cloth A comes back to the needle position NP.

Figure 13:
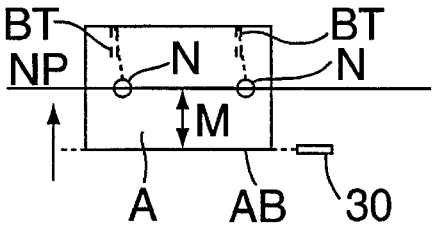
FIG. 13 is a view for explaining the operation of the mask sewing device in FIG. 1

When forming the back tack stitches BT by backward sewing as many as those formed by forward sewing is completed, the forward sewing is performed being released from the programmed control until the rear end portion AB of the mask cloth A is detected by the sensor 30 as illustrated in FIG. 13.

Figure 14:
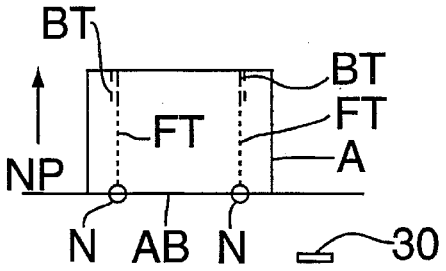
FIG. 14 is a view for explaining the operation of the mask sewing device in FIG. 1

The programmed control is resumed based on the detection signal (OFF) produced by the sensor 30 and the pulse motor 11 is turned normally (the mask cloth A is fed forward) under the programmed control to form a given number of stitches in forward sewing (the distance M illustrated in FIG. 13) until the rear end portion AB reaches the needle position NP as illustrated in FIG. 14, during which the stitch lines FT which stitch the folded end portions A1 and A2 together are formed.

Figure 15:
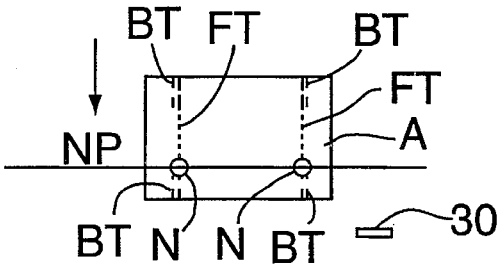
FIG. 15 is a view for explaining the operation of the mask sewing device in FIG. 1.

The pulse motor 11 is rotated reversely again under the programmed control to form the back tack stitches BT of a given number of stitches in backward sewing as illustrated in FIG. 15. Then the pulse motor 11 is rotated normally to form the back tack stitches BT by forward sewing as far as adjacent to the rear end portion AB as illustrated in FIG. 16 to complete the programmed control. When the programmed control is completed, the sewing machines 1 and 1 are turned off to complete sewing a piece of mask. The mask is fed forward by the endless belts 14 by keeping the normal rotation of the pulse motor 11.

As described above, the mask cloths A successively inserted into the mask sewing device are sewn by way of the normal and reverse rotation of the pulse motor 11 interlocking with the operation of the sewing machines 1 and 1 based on the detection of the front end portion AF and rear end portion AB thereof. As the mask cloths A are successively inserted into a feeding path defined by the guide members 4 and the mask cloth carrier plate 5 by normally rotating the pulse motor 11 alone while stopping the operation of the sewing machines 1 and 1 as illustrated in FIG. 17, masks completed in sewing are successively sent out from the sending-out side Y.

As understood from the above description, since the mask cloth is sewn by a pair of sewing machines while belts are driven normally and reversely by a feeding unit to feed the folded mask cloth forward and backward on the working table, it is possible to efficiently sew a mask of high quality in which stitch lines on both sides thereof are uniform and symmetrical to each other. As a result, it is possible to make practiceable the sewing processes in a sewing factory.

What is claimed is:

1. A mask sewing device characterized in comprising:

a pair of sewing machines which are fixed left and right on a working table in such a way as to face each other and are operated in synchronism with each other said table having a mask cloth feeding side and a mask cloth sending-out side;

a pair of belts provided apart from each other on said working table by a given interval, each belt extending between the mask cloth feeding side and mask cloth sending-out side of said working table; and a feeding unit for driving said belts in the normal and reverse directions, wherein said sewing machines concurrently sew folded end portions of said mask cloth along a seam line of the cloth, said mask cloth being inserted into said interval from said feeding side;

said feeding unit including: a pair of supporting members which face each other on said working table with a given interval therebetween said supporting members each having a lower portion;

at least three rotating shafts, two of which extend between the lower portions of the supporting members;

a driving shaft;

pulleys a pair of which are fixed to each of said rotating shafts and driving shaft; and a rotation drive source for driving the two belts wound around said pulleys.

2. A mask sewing device according to claim 1, characterized in that when said mask cloth is inserted in said interval each belt is positioned adjacent to each seam line in the folded end portions at the outer edge portion thereof, each belt being normally and reversely driven and equipped with a presser foot which adjustably contact an upper surface of the belt so as to clamp said mask cloth between said each belt pressed down by said presser foot and a mask cloth carrier plate which is provided on said working table for carrying said mask cloth thereon.

* * * * *